US008919837B1

(12) United States Patent
Cauchi

(10) Patent No.: US 8,919,837 B1
(45) Date of Patent: Dec. 30, 2014

(54) LIFTING DEVICE FOR RC CARS

(71) Applicant: Joe Cauchi, Pyramid Hill (AU)

(72) Inventor: Joe Cauchi, Pyramid Hill (AU)

( * ) Notice: Subject to any disclaimer, the term of this patent is extended or adjusted under 35 U.S.C. 154(b) by 0 days.

(21) Appl. No.: 14/255,636

(22) Filed: Apr. 17, 2014

(51) Int. Cl.
*B65G 7/12* (2006.01)
*A45F 5/00* (2006.01)

(52) U.S. Cl.
CPC ..... *A45F 5/00* (2013.01)
USPC ..... 294/16; 294/28; 294/164

(58) Field of Classification Search
CPC ..... B65G 7/12; B65G 7/00; A63H 15/04; A63H 15/00; A63H 7/00; A63H 17/002; A63H 17/264; B60R 7/08
USPC ..... 294/16, 26, 28, 62, 106, 164, 118, 903; 211/13.1, 85.8, 41.4; 269/2, 77, 86, 269/237; 16/423; 118/503
See application file for complete search history.

(56) References Cited

U.S. PATENT DOCUMENTS 1,728,084 A * 9/1929 Shroyer ..... 294/118
1,787,331 A * 12/1930 Wilson ..... 294/118
3,059,954 A * 10/1962 Matejicek ..... 294/16
3,222,034 A 12/1965 Jackson
3,269,764 A * 8/1966 Coleman ..... 294/16
3,820,837 A * 6/1974 Fredrickson ..... 294/16
4,109,952 A * 8/1978 Monzain ..... 294/16
4,268,020 A * 5/1981 Wood ..... 269/88
4,463,977 A * 8/1984 Wyatt ..... 294/26
4,477,113 A * 10/1984 Lybolt ..... 294/16
4,615,555 A 10/1986 Bateham
5,192,104 A 3/1993 Lin
5,871,244 A * 2/1999 Langford ..... 294/16
6,152,505 A * 11/2000 Coyne ..... 294/16
7,066,510 B1 * 6/2006 Guintu ..... 294/16
8,245,856 B1 * 8/2012 Pappin et al. ..... 211/13.1

* cited by examiner

*Primary Examiner* — Paul T Chin
(74) *Attorney, Agent, or Firm* — Crossley Patent Law

(57) ABSTRACT

A lifting device for RC cars including a first support wire having an upper section, a first side section, and a second side section. A brace is medially disposed between a first bend and a second bend of each of the first and second side sections. An L-shaped support is disposed on each of the first and second side sections. The lifting device also includes a hinge medially disposed upon the upper section. An elongated hook and a second support wire are disposed on the hinge. A C-shaped loop is medially disposed upon the upper section. The device is configured to engage with and support the weight of one of each of a variety of differently shaped RC cars and RC car remote controls.

7 Claims, 5 Drawing Sheets

LIFTING DEVICE FOR RC CARS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of lifting devices are known in the prior art. However, what is needed is a lifting device for RC cars including a first support wire having an upper section, a first side section, and a second side section. A brace is medially disposed between a first bend and a second bend of each of the first and second side sections. An L-shaped support is disposed on each of the first and second side sections. The lifting device also includes a hinge medially disposed upon the upper section. An elongated hook and a second support wire are disposed on the hinge. A C-shaped loop is medially disposed upon the upper section. Wherein the device is configured to engage with and support the weight of a RC car and a RC car remote control.

FIELD OF THE INVENTION

The present invention relates to a lifting device, and more particularly, to a lifting device for RC cars.

SUMMARY OF THE INVENTION

The general purpose of the present lifting device for RC cars, described subsequently in greater detail, is to provide a lifting device for RC cars which has many novel features that result in a lifting device for RC cars which is not anticipated, rendered obvious, suggested, or even implied by prior art, either alone or in combination thereof.

The lifting device for RC cars includes a first support wire having an upper section, a first side section, and a second side section. The first side section is continuously disposed upon a proximal end of the upper section. The second side section is disposed upon a distal end of the upper section. Each of the first and second side sections are substantially perpendicular to the upper section. The first wire support can be either a single sheet of molded or welded metal, or the first side section and the second side section can be individual components affixed by threaded means.

A hinge is medially disposed upon the upper section. An elongated hook and a second support wire are diametrically disposed on the hinge. The hinge is configured to rotate about an axis of the upper section. The second support wire and the hook are configured to adjust with the rotation of the hinge. The hook is configured to hang from a structure and support the weight of a RC car and a RC car remote control upon the first support wire and the second support wire. The hinge allows the second support wire to adjust to allow for easy engagement of the first and second support wires with the RC car.

Each of the first side section, the second side section, and the second support wire have a first bend at a substantially obtuse angle and a second bend at a substantially right angle. An L-shaped support is disposed on each of the first side section and the second side section proximal the first bend, respectively. The L-shaped supports are collectively configured to support the weight of a RC car remote control.

A single brace is medially disposed between the first bend and the second bend of each of the first side section and the second side section. The brace is configured to support each of the first side section and the second side section at a distance roughly the equivalent length of the undercarriage of an RC car.

A C-shaped loop is medially disposed upon the upper section and is configured to serve as an auxiliary support for hanging items. Each of the first side section, the second side section, and the second support wire have a terminal end. A rubber foot member is disposed on each of the terminal ends. The terminal ends are collectively configured to support the weight of a RC car. Each of first support wire and the second support wire are coated in a rubber-like polymer material, so as to prevent scratching of the RC car when engaged with the lifting device for RC cars. Each of first support wire and the second support wire are also rigidly pliable for accepting a variety of RC car shapes and sizes.

Thus has been broadly outlined the more important features of the present lifting device for RC cars so that the detailed description thereof that follows may be better understood and in order that the present contribution to the art may be better appreciated.

Numerous objects, features and advantages of the present lifting device for RC cars will be readily apparent to those of ordinary skill in the art upon reading the following detailed description of presently preferred, but nonetheless illustrative, examples of the present lifting device for RC cars when taken in conjunction with the accompanying drawings.

BRIEF DESCRIPTION OF THE DRAWINGS

Figures

DETAILED DESCRIPTION OF THE DRAWINGS

Figure 1:
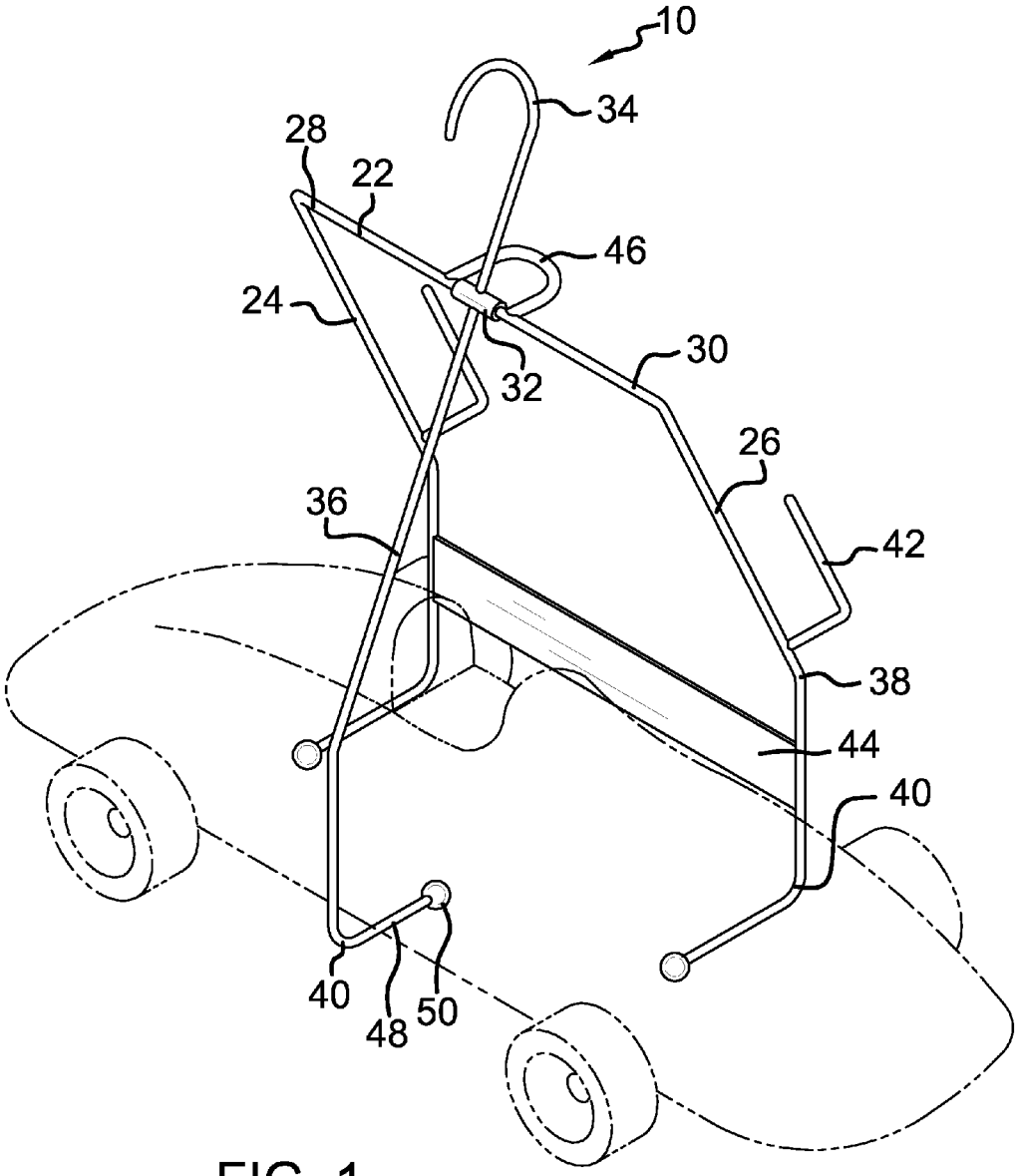
FIG. 1 is an frontal isometric view of the device in use.
Figure 2:
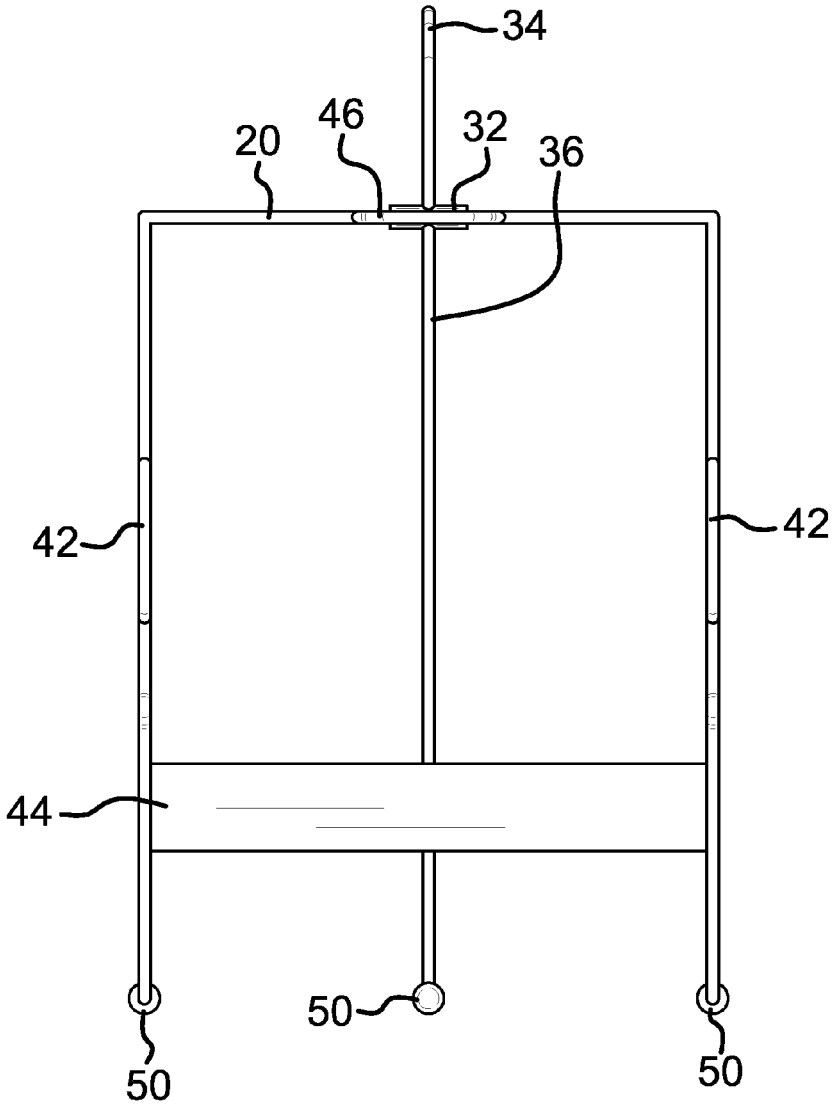
FIG. 2 is a rear view.
Figure 3:
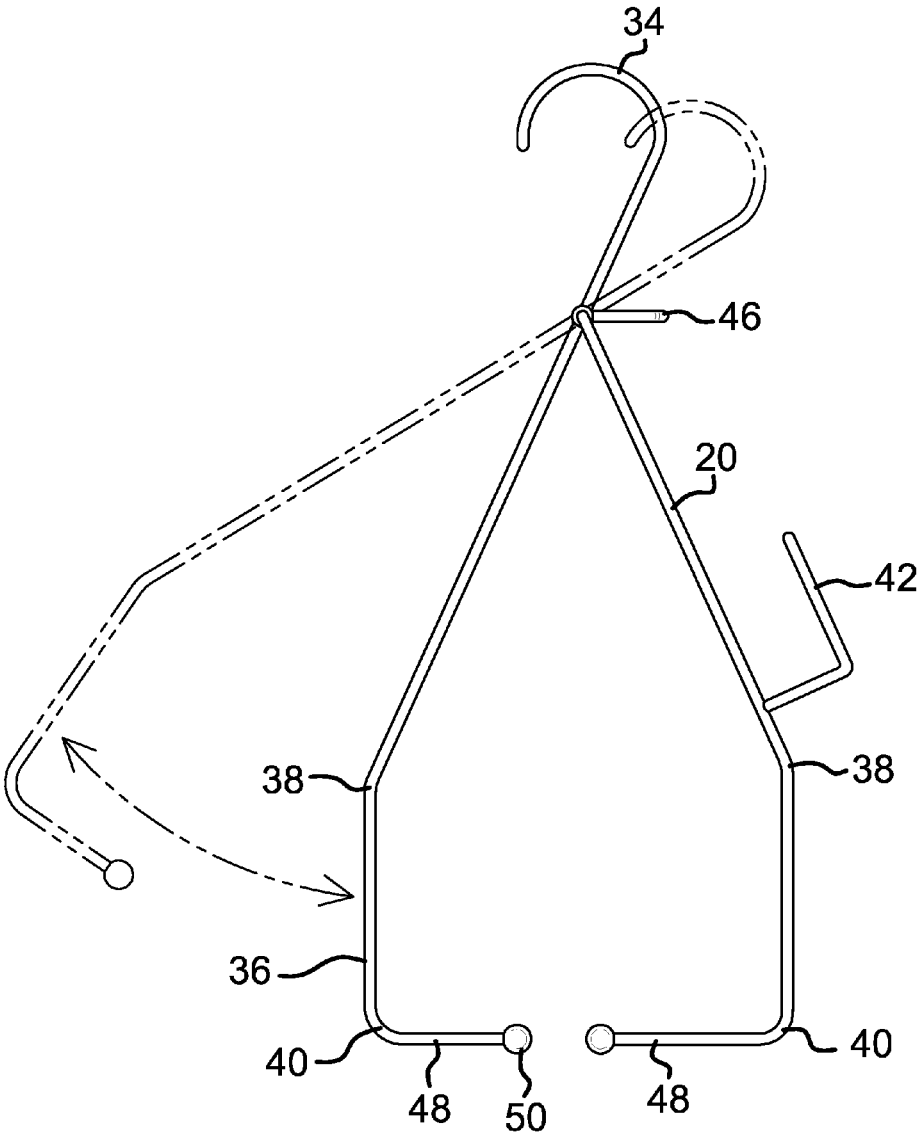
FIG. 3 is a side view showing adjustment of a hinge.
Figure 4:
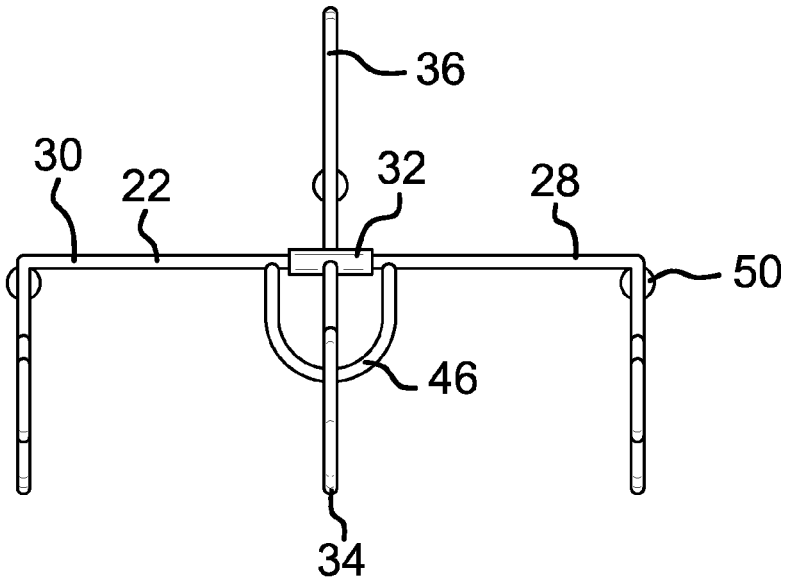
FIG. 4 is a top view.
Figure 5:
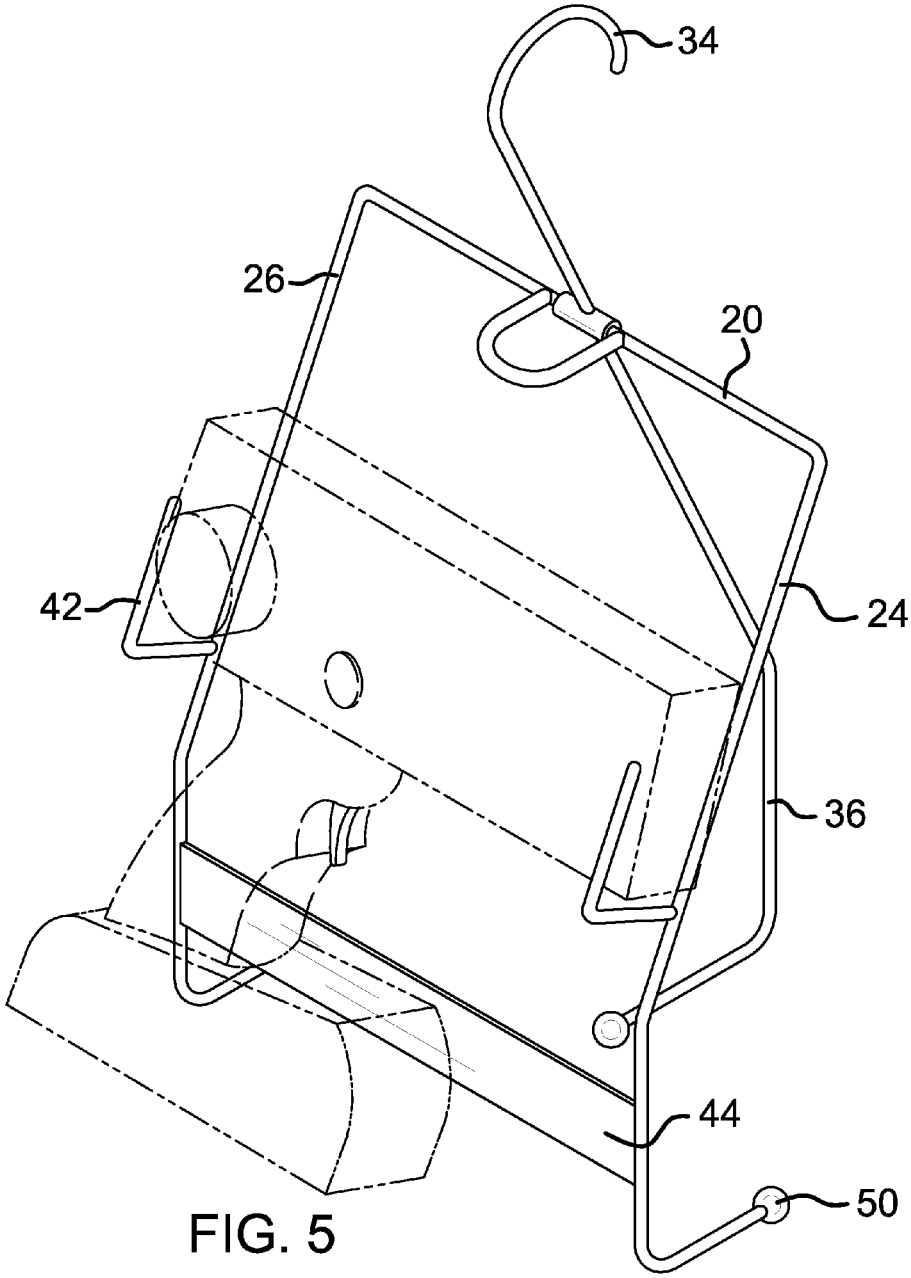
FIG. 5 is a rear isometric view of the device in use.

With reference now to the drawings, and in particular FIGS. 1 through 5 thereof, the instant lifting device for RC cars employing the principles and concepts of the present lifting device for RC cars and generally designated by the reference number 10 will be described. Referring to FIGS. 1 through 5 a preferred embodiment of the present lifting device for RC cars 10 is illustrated.

The lifting device for RC cars 10 includes a first support wire 20 having an upper section 22, a first side section 24, and a second side section 26. The first side section 24 is continuously disposed upon a proximal end 28 of the upper section 22. The second side section 26 is disposed upon a distal end 30 of the upper section 22. Each of the first side section 24 and the second side section 26 are substantially perpendicular to the upper section 22.

A hinge 32 is medially disposed upon the upper section 22. An elongated hook 34 and a second support wire 36 are diametrically disposed on the hinge 32. The hinge 32 is configured to rotate about an axis of the upper section 22. The second support wire 36 and the hook 34 are configured to adjust with the rotation of the hinge 32. The hook 34 is configured to hang from a structure and support the weight of a RC car and a RC car remote control upon the first support wire 20 and the second support wire 36.

Each of the first side section 24, the second side section 26, and the second support wire 36 have a first bend 38 at a substantially obtuse angle and a second bend 40 at a substantially right angle. An L-shaped support 42 is disposed on each of the first side section 24 and the second side section 26 proximal the first bend 38, respectively. The L-shaped supports 42 are collectively configured to support the weight of a RC car remote control.

A single brace 44 is medially disposed between the first bend 38 and the second bend 40 of each of the first side section 24 and the second side section 26. The brace 44 is configured to support each of the first side section 24 and the second side section 26 at a distance roughly the equivalent length of the undercarriage of an RC car.

A C-shaped loop 46 is medially disposed upon the upper section and is configured to serve as an auxiliary support for hanging items. Each of the first side section 24, the second side section 26, and the second support wire 36 have a terminal end 48. A rubber foot member 50 is disposed on each of the terminal ends 48. The terminal ends 48 are collectively configured to support the weight of a RC car. Each of first support wire 20 and the second support wire 36 are coated in a rubber-like polymer material, so as to prevent scratching of the RC car when engaged with the lifting device for RC cars. Each of first support wire 20 and the second support wire 36 are also rigidly pliable for accepting a variety of RC car shapes and sizes.

What is claimed is:

1. A lifting device for RC cars comprising:

a first support wire having an upper section, a first side section, and a second side section, the first side section continuously disposed upon a proximal end of the upper section, the second side section disposed upon a distal end of the upper section, each of the first side section and the second side section substantially perpendicular to the upper section;

a hinge medially disposed upon the upper section;

an elongated hook disposed on the hinge;

a second support wire disposed on the hinge;

each of the first side section, the second side section, and the second support wire having a first bend at a substantially obtuse angle and a second bend at a substantially right angle;

an L-shaped support disposed on each of the first side section and the second side section proximal the first bend, respectively;

a brace medially disposed between the first bend and the second bend of each of the first side section and the second side section, the brace configured to support each of the first side section and the second side section at a distance;

wherein each of the first side section, the second side section, and the second support wire having a terminal end configured to support the weight of a RC car;

wherein the hinge is configured to rotate about an axis of the upper section;

wherein the second support wire and the hook are configured to adjust with the rotation of the hinge; and wherein the L-shaped support is configured to support the weight of a RC car remote control.

2. The lifting device for RC cars of claim 1 further comprising:

a C-shaped loop medially disposed upon the upper section.

3. The lifting device for RC cars of claim 2 further comprising:

a rubber foot member disposed on each of the terminal ends.

4. The lifting device for RC cars of claim 3 wherein each of first support wire and the second support wire are coated in a rubber-like polymer material.

5. The lifting device for RC cars of claim 4 wherein each of first support wire and the second support wire are rigidly pliable.

6. The lifting device for RC cars of claim 5 wherein the hook is configured to hang from a structure and support the weight of the RC car and the RC car remote control upon the first support wire and the second support wire.

7. A lifting device for RC cars comprising:

a first support wire having an upper section, a first side section, and a second side section, the first side section continuously disposed upon a proximal end of the upper section, the second side section disposed upon a distal end of the upper section, each of the first side section and the second side section substantially perpendicular to the upper section;

a hinge medially disposed upon the upper section;

an elongated hook disposed on the hinge;

a second support wire disposed on the hinge;

each of the first side section, the second side section, and the second support wire having a first bend at a substantially obtuse angle and a second bend at a substantially right angle;

an L-shaped support disposed on each of the first side section and the second side section proximal the first bend, respectively;

a brace medially disposed between the first bend and the second bend of each of the first side section and the second side section, the brace configured to support each of the first side section and the second side section at a distance;

a C-shaped loop medially disposed upon the upper section;

each of the first side section, the second side section, and the second support wire having a terminal end;

a rubber foot member disposed on each of the terminal ends; and wherein the hinge is configured to rotate about an axis of the upper section;

wherein the second support wire and the hook are configured to adjust with the rotation of the hinge;

wherein the terminal ends are configured to support the weight of a RC car;

wherein the L-shaped support is configured to support the weight of a RC car remote control;

wherein each of first support wire and the second support wire are coated in a rubber-like polymer material;

wherein each of first support wire and the second support wire are rigidly pliable; and wherein the hook is configured to hang from a structure and support the weight of the RC car and the RC car remote control upon the first support wire and the second support wire.

* * * * *